US010265669B2

(12) United States Patent
Rüberg et al.

(10) Patent No.: US 10,265,669 B2
(45) Date of Patent: Apr. 23, 2019

(54) MIXING MACHINE AND DISCHARGING STATION

(71) Applicant: Dr. Herfeld GmbH & Co. KG, Neuenrade (DE)

(72) Inventors: Wolfgang Rüberg, Menden (DE); Ulrich Tölle, Detmold (DE)

(73) Assignee: DR. HERFELD GMBH & CO. KG, Neuenrade (DE)

( * ) Notice: Subject to any disclaimer, the term of this patent is extended or adjusted under 35 U.S.C. 154(b) by 262 days.

(21) Appl. No.: 15/189,275

(22) Filed: Jun. 22, 2016

(65) Prior Publication Data

US 2016/0375416 A1 Dec. 29, 2016

(30) Foreign Application Priority Data

Jun. 23, 2015 (DE) ..... 20 2015 103 285 U

(51) Int. Cl.
*B01F 15/02* (2006.01)
*B01F 15/00* (2006.01)
*B01F 11/00* (2006.01)

(52) U.S. Cl.
CPC ..... *B01F 15/0278* (2013.01); *B01F 11/0048* (2013.01); *B01F 15/0085* (2013.01); *B01F 15/00837* (2013.01); *B01F 15/00844* (2013.01)

(58) Field of Classification Search
CPC ..... B01F 15/0278
(Continued)

(56) References Cited

U.S. PATENT DOCUMENTS 2,398,985 A 4/1946 Welch
2,797,903 A 7/1957 Urban
(Continued)

FOREIGN PATENT DOCUMENTS

DE 1814381 A1 8/1969
DE 2250432 A1 4/1974
(Continued)

OTHER PUBLICATIONS

Search report dated Dec. 5, 2016 in related European application EP 16175173.0-1703.
(Continued)

*Primary Examiner* — David L Sorkin
(74) *Attorney, Agent, or Firm* — Polson Intellectual Property Law P.C.; Christopher R. Sylvain; Margaret Polson

(57) ABSTRACT

A mixing container 1 with a top filling opening 5, with a connection flange 9, 9.1 which projects outward in the area of the top filling opening 5 in a radial direction for connecting the mixing container 1 to the mixing head of an industrial mixing machine and with a bottom discharge 13 that can be blocked and opened comprises a mixing receptacle 3, 3.1 forming the hollow chamber 4 of the mixing container 1 and with a wall 18, 19 encompassing its hollow chamber and flexible in a radial direction and comprises a container frame 2 holding the mixing receptacle 3, 3.1 and with the connection flange 9 and the discharge 13. The container frame 2 holds the mixing receptacle 3, 3.1, in such a manner that its wall 18, 19 surrounding the hollow chamber 4 is at least partially accessible in the circumferential direction for bringing about a deformation of it in the radial direction.

11 Claims, 6 Drawing Sheets

(58) Field of Classification Search
USPC ..... 366/184, 189, 275; 222/214
See application file for complete search history.

(56) References Cited

U.S. PATENT DOCUMENTS

| | | | | |
|---|---|---|---|---|
| 3,588,054 | A | 6/1971 | Ljungberg et al. | |
| 4,781,468 | A | 11/1988 | Herfeld | |
| 4,889,432 | A | 12/1989 | Patterson | |
| 4,951,843 | A | 8/1990 | Paetow | |
| 5,632,906 | A * | 5/1997 | Ishida | A61M 1/029 210/109 |
| 5,727,878 | A | 3/1998 | Sullivan, Jr. | |
| 6,505,657 | B1 | 1/2003 | Lawrence | |
| 8,678,639 | B2 | 3/2014 | Tolle et al. | |
| 8,979,354 | B2 | 3/2015 | Tolle et al. | |
| 2008/0123466 | A1* | 5/2008 | Thompson | B01F 11/0042 366/275 |
| 2009/0040868 | A1 | 2/2009 | Tamminga | |
| 2010/0065149 | A1 | 3/2010 | O'Callaghan | |
| 2011/0286300 | A1 | 11/2011 | Kreis et al. | |
| 2012/0175012 | A1 | 7/2012 | Goodwin et al. | |
| 2013/0186834 | A1 | 7/2013 | Vicalvi et al. | |
| 2015/0078119 | A1 | 3/2015 | Ruberg et al. | |
| 2015/0290607 | A1 | 10/2015 | Tolle | |

FOREIGN PATENT DOCUMENTS

| | | | |
|---|---|---|---|
| DE | 4320246 | A1 | 12/1993 |
| DE | 102010016595.6 | A1 | 10/2011 |
| EP | 0892255 | A1 | 1/1999 |
| GB | 1413350 | | 11/1975 |
| GB | 1413350 | A | 11/1975 |
| GB | 2240965 | A | 8/1991 |
| GB | 2267899 | A | 12/1993 |
| GB | 2363787 | A | 1/2002 |

OTHER PUBLICATIONS

European Search Report in related European patent application 16175173.0 dated Feb. 27, 2017. 13 pages.
Pending utility U.S. Appl. No. 14/456,044, filed Aug. 11, 2014, inventors Ruberg et al.
Pending utility U.S. Appl. No. 15/190,426, filed Jun. 23, 2016, inventors Ruberg et al.

* cited by examiner

MIXING MACHINE AND DISCHARGING STATION

CROSS REFERENCE APPLICATIONS

This application is a non-provisional application claiming priority to German application 20 2015 103 285.4 filed Jun. 23, 2015, which is incorporated by reference herein for all purposes.

BACKGROUND

The invention relates to a mixing container with a top filling opening, with a connection flange which projects outward in the area of the top filling opening in a radial direction for connecting the mixing container to the mixing head of an industrial mixing machine and with a bottom discharge that can be blocked and opened. Furthermore, the invention relates to an emptying station for such a mixing container.

Mixing containers of this type are connected to a mixing machine for mixing material to be mixed this container. Such mixing machines are industrial mixers which are used for mixing bulk material in particular, typically powdery bulk material such as for preparing mixtures of plastic granulate or in the color industry. These mixing machines comprise a mixing head pivotably supported opposite a frame. The mixing head also serves to simultaneously close a mixing container which is connected to the mixing head for mixing the material. After the mixing container has been connected to the mixing head a closed receptacle is formed by the mixing head and the container containing the material to be mixed. For connecting the mixing container to the mixing head the mixing head comprises one or more connecting elements, for example a circumferential flange as support surface for a complementary connection flange of the mixing container and comprises locking members for locking the mixing container on the mixing head. Due to the fact that in these mixing machines have a mixing container connected to the mixing head these mixers are also known as container mixers. The mixing head itself is pivotably arranged opposite the machine frame of the mixing machine such that the mixing takes place relative to the mixing head in an upside down position in which the mixing head is at the bottom and the mixing container connected to it is arranged at the top. In this position the bottom discharge opening of the mixing container faces upward.

This upside down position is required so that the material to be mixed comes in contact with the at least one mixing tool carried by the mixing head. The rotationally driven mixing tool serves to generate a flow of material to be mixed inside the closed mixing chamber. The time of the mixing procedure determines the degree of mixing. Such an industrial mixer is known, for example, from EP 0 225 495 A2.

Mixing containers of the previously described type are manufactured from stainless steel in order that they satisfy the requirements placed on the container. The filling opening of the mixing container is formed by the upper closure of an annular, cylindrical wall. A truncated cone section constructed as a ring borders this wall in the direction of the discharge by which the inside diameter of the container tapers from a cylindrical diameter to the diameter of the discharge. A blocking flap is built into the discharge, which is typically constructed as a discharge conduit, for opening and closing it. This flap can generally be manually activated from the outside by a lever. Once the material is mixed, the mixing container is moved with the mixed mixing material to an emptying station. In this station the discharge is connected to the inlet of the next processing station. Then the blocking flap is opened so that the pourable mixed material contained in the mixing container can flow out of it, emptying the mixing container. The emptying of such a mixing container takes place as a function of the processing station connected in downstream in one batch or in several smaller batches. In the latter instance the mixing container also serves as a storage container.

When emptying pourable mixing material bridges of mixing material can form in the conically tapered section. In such an instance only the mixing material located below such a mixing material bridge can flow out of the mixing container without additional measures. Such mixing material bridges are produced by compaction of the mixing material located in the mixing container by reduction of the pore volume, typically as a process of material being set in the area of the tapered container section, favored by the weight of the mixing material located above it. In order to avoid the formation of such mixing material bridges or also to destroy present mixing material bridges to ensure a complete emptying of the mixing container, a vibration motor or a knocking generator is connected into the emptying station on the outer wall of the mixing container. As a result of the oscillations introduced into the container wall in this manner the mixing material contained in the mixing container during the process of emptying is put or held in motion and therefore fluidized to a certain extent, which counteracts a production of mixing material bridges during the emptying. Such a measure can destroy produced mixing material bridges.

Even if an orderly emptying of bulk material from the mixing container can be ensured with these measures and in particular also bulk material which tends to form mixing material bridges, the associated, unavoidable development of noise is considered as disadvantageous. The noise level when using such a vibration motor or knocking generator is significant.

Starting from this discussed prior art, the invention therefore has the problem of constructing a mixing container of the initially cited type in such a manner that it can be emptied without an appreciable additional development of noise in an orderly manner even if filled with mixing material which tends to form mixing material bridges.

The foregoing example of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

On aspect of the present disclosure is an initially cited generic mixing container in which the mixing container comprises a mixing receptacle forming a hollow chamber of the mixing container with a wall encompassing its hollow chamber and flexible in a radial direction and comprises a container frame with the connection flange and the discharge, which container frame holds the mixing receptacle, and on which container frame the mixing receptacle is held in such a manner that its wall encompassing the hollow chamber is at least partially accessible for bringing about a deformation of it in the circumferential direction.

This mixing container comprises a flexible mixing receptacle and a container frame in which the flexible mixing receptacle is held. At least the wall surrounding the hollow chamber of the mixing receptacle has flexible properties so that it can be deformed by external action. A deformation acting from the outside on this wall causes it to be pressed in, causing a change in the geometry of the hollow chamber surrounded by the wall. A mixing material bridge formed in the hollow chamber of the mixing receptacle is simply destroyed by such a deformation of the wall. While in the initially sketched, previously known concept a destruction of mixing material bridges takes place by coupling oscillations into the mixing material in order to destabilize the support of the mixing material particles among each other in order to cause the mixing material bridge to collapse by the weight of the mixing material located above it and acting on it, this is possible in the case of the claimed mixing container by the change in the geometry of the inner hollow chamber of the mixing roller and by a cancelling of particle supports forming the mixing material bridge, which cancellation is brought about by the deformation. The local pressing in of the flexible wall of the mixing container can shift the support of the mixing material bridge at this position, which naturally leads to a collapse of the mixing material bridge. This can be carried out by a pressure body acting from the outside on this wall, for example by a pneumatically or hydraulically adjustable piston-cylinder arrangement. A pressing in of the wall of the mixing material receptacle does not cause any noise.

In this mixing container the shape of the mixing receptacle is sufficiently stable when held in the container frame, that the hollow chamber necessary for the mixing process without collapsing is maintained. Such a receptacle therefore has a sufficient wall thickness. It should be taken into consideration here that the mixing receptacle is held by the container frame, wherein the mixing receptacle is connected according to a preferred embodiment by its upper and its lower closures to the container frame. Therefore, the mixing receptacle is held in the direction of its height by the container frame. For the rest, the stability of the shape of the wall surrounding the hollow chamber is sufficient to prevent an undesired collapsing of this wall during the mixing process.

In a preferred exemplary embodiment, the mixing process is carried out with such a mixing container with a raised pressure in the hollow chamber containing the material to be mixed when the mixing container is connected to the mixing head of a mixing machine. This raise pressure, which can be, for example 0.3-0.5 bar above ambient pressure, builds up during the mixing process and can support the retention of the shape of the flexible wall surrounding the hollow chamber. Therefore, such a mixing container is in particular suitable for carrying out a mixing process when it is connected to a mixing machine, which is provided in any case for carrying out the mixing process with a certain raised pressure. This is the case, for example in mixing machines in which washing air is introduced from the outside through the particular bearing into the hollow mixing chamber for sealing the drive shafts of the mixing tool or tools, as is the case for slot seals. In a preferred further development, the mixing receptacle is manufactured from a material that can expand elastically at least to a certain extent. It is provided here that during the mixing of the mixing material in a mixing container with such a receptacle its volume is increased when a raised pressure forms in the hollow mixing chamber, for example on the previously cited order of magnitude. The increase in volume of the mixing receptacle which accompanies the elevation of pressure in the mixing receptacle brings about a slow rise of pressure inside the hollow chamber. This is especially advantageous when material to be mixed is mixed in the mixing container which should be mixed only with a maximum internal pressure and/or only with a maximum temperature effect in the mixing container. Whereas the duration of the mixing process is limited by this condition in traditional mixing containers, when using a mixing container of the previously described type the mixing time can be dimensioned to be longer based on the slower internal elevation of pressure. This is adjusted by the elasticity of the material selected for the manufacture of the mixing receptacle and of the wall strength. In order to achieve a lengthening of the mixing time which is significant for the mixing process, for example 10-20%, this is already achieved with a relatively slight extension of the wall of the mixing receptacle based on the size of such mixing containers (for example 2000 liters).

In a mixing container in which the mixing receptacle has the previously described, elastically expandable wall properties the container frame is preferably designed to limit the maximum wall expansion. To this extent in the case of such a design the mixing receptacle is manufactured as regards the holding of the container frame with a certain undersize as regards the radial expansion of the mixing receptacle. The support of the container frame in this regard can be made available by struts, strips, wall segments or the like against which support the outer wall of the mixing receptacle is pressed given a corresponding elevation of the internal pressure.

In order to connect the mixing receptacle to the container frame the mixing receptacle comprises in the area of its filling opening a circumferential, outwardly projecting holding flange which is brought for the contact onto the surface, facing the mixing head, of the connection flange of the container frame. The holding flange is preferably fixed on the connection flange of the container frame in that the holding flange carries a connection continuation formed on it in the manner of a braided edge, which connecting continuation engages into a circumferential groove formed in this surface of the connection flange of the container frame. This groove can be undercut. The connection continuation of the mixing receptacle then advantageously comprises a thickened area designed as a hollow chamber for an easier introduction into the undercut groove which thickened area engages into the undercut of the groove in the contact flange. According to an embodiment the mixing receptacle comprises in the area of its lower discharge end a flange which also projects radially outward and is connected to a complementary flange in the area of the entrance of the discharge of the container frame. For example, rapid clamps can be used for fixing the flanges which then lie on one another in a sealed manner.

Based on the material properties of the mixing receptacle this material can serve at the same time for the necessary seal between the mixing container and the mixing head of the mixing machine so that additional seals are not required for the connection of the mixing container to the mixing head or for connecting the discharge-side end of the mixing receptacle to the discharge of the container frame.

In addition, the manufacture of the mixing receptacle from an elastomer or a polymer with appropriate elastic properties allows a coating of the inner surface with a material which reduces adhesion such as, for example, PTFE (polytetrafluoroethylene). This is remarkable in as far as steel surfaces cannot be provided or in any case not very easily provided with such coatings, in particular with a PTFE coating. Instead of the application of such a coating, which has in particular as a consequence a simplified cleaning of the mixing container, the inner surface of the mixing receptacle can also have an adhesion-reducing surface structuring. A combination of these measures is also possible.

The previously described mixing container not only has the advantage that the wall surrounding the hollow chamber can be milled in order to prevent the formation of mixing material bridges and/or to eliminate existing mixing material bridges but also the fact that the mixing receptacle can be removed from the container frame. In order to mix a first mixing material a first mixing receptacle can be used that is replaced by a second mixing receptacle when another mixing material is to be mixed. The first, replaced mixing receptacle can be stored in a space-saving manner on account of its flexible wall properties, for example, on a shelf. To this extent several mixing receptacles can be provided for each material relative to a container frame, which containers are associated with a material to be mixed in them and are mounted as needed in or on the container frame. As a result, cleaning work on the mixing container can be reduced to a minimum when mixing batches of different materials. A cleaning is then necessary only at the discharge.

In addition to the exemplary aspects and embodiments described above, further aspects and embodiments will become apparent by reference to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION

Figure 1:
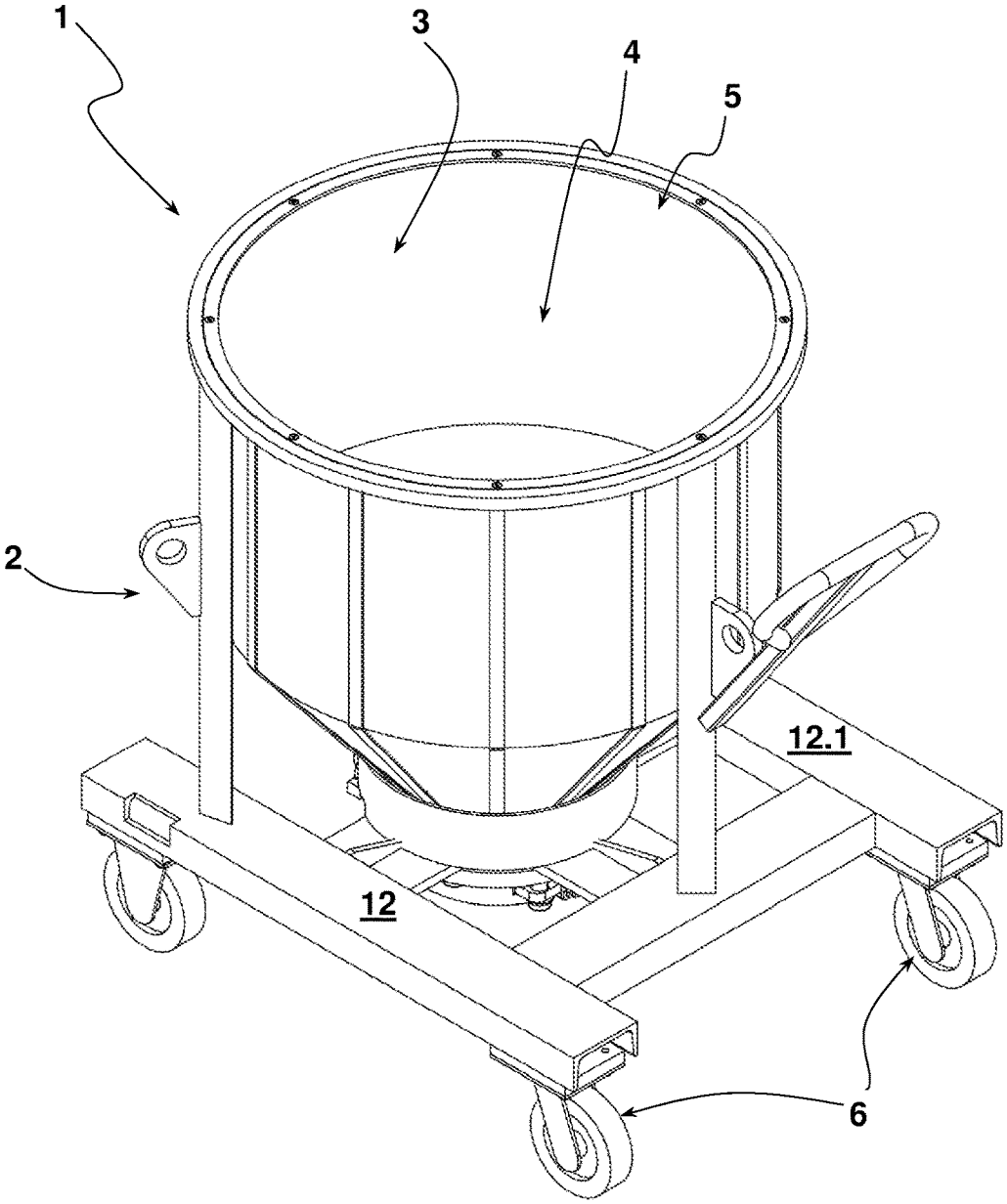
FIG. 1 is a perspective view of a mixing container comprising a container frame and a mixing receptacle held in it.

A mixing container 1 comprises a container frame characterized in its entirety by the reference number 2 in FIG. 1 and a mixing receptacle 3 which is held in the container frame 2. The mixing receptacle 3 surrounds a hollow chamber 4 into which material to be mixed can be introduced through the upper filling opening 5 recognizable in FIG. 1. As regards this functionality the mixing container 1 corresponds to those known from previously known mixing containers. The container frame 2 is seated on pivot rollers 6 so that it can be readily moved.

Figure 2:
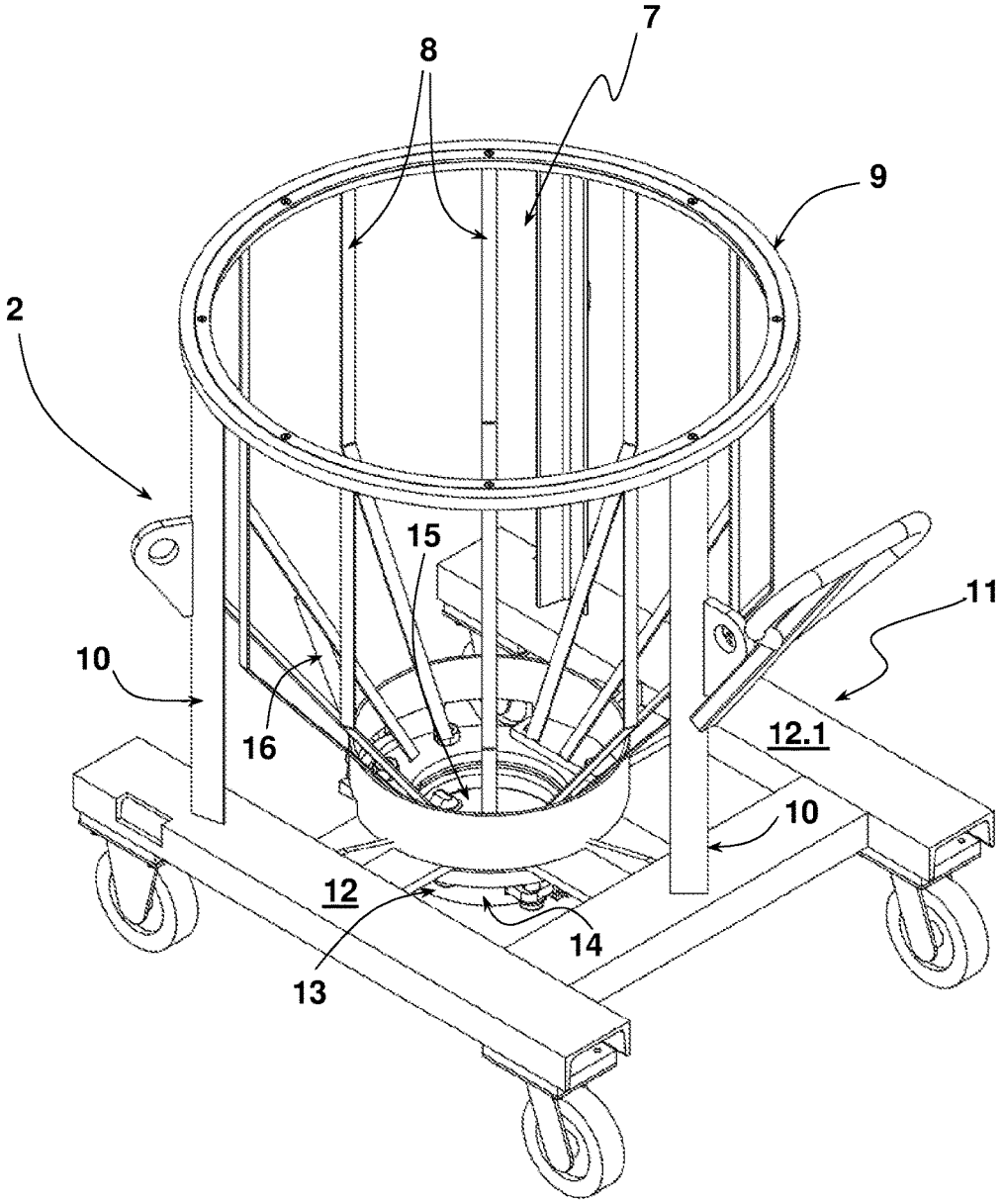
FIG. 2 is a perspective view of the container frame of the mixing container of FIG. 1.

The container frame 2 of the exemplary embodiment shown makes a receptacle receiver 7 available into which the mixing receptacle 3 is inserted (see FIG. 2). This receptacle receiver 7 is made available by several strips 8 which are arranged circumferentially with the same or approximately the same angular distance from each other and which represent the support for the outer wall of the mixing receptacle 3 in the radial direction. The shape of the strips 8 is adapted to the outer shape of the mixing receptacle 3 in the direction of its longitudinal extension. The strips 8 are connected to an upper ring which forms its connection flange 9 as regards the mixing container 1. The mixing container 1 is connected by its connection flange 9 to the mixing head of an industrial mixing machine, for example like the one known from DE 20 2014 101 787 U1 or from DE 20 2009 001 937 U1. These mixing machines are designed so that during the mixing procedure no or at least no appreciable heat is added into the mixing material during the mixing process. A mixing without the adding of heat is preferred when using the mixing container 1.

In addition, the connection flange 9 is supported by columns 10 on a carriage 11 carrying the pivot rollers 6 as part of the container frame 2. A discharge 13 is arranged between two longitudinal struts 12, 12.1 of the carriage 11. The discharge 13 comprises a discharge conduit 14 in which a closure flap 15, present in closed position in FIG. 2, is arranged. The closure flap 15 can be activated by pivoting a lever. The upper closure of the discharge conduit 14 carries a connection flange for closing the mixing receptacle 3.

Figure 3:
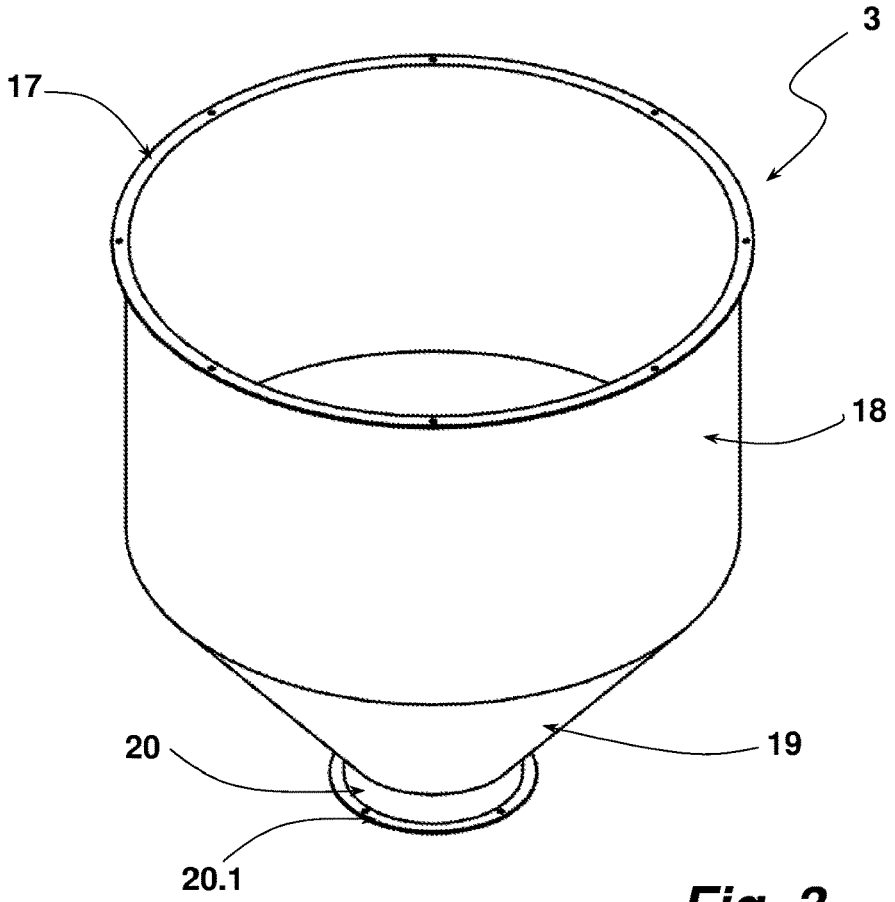
FIG. 3 is a perspective view of the mixing receptacle of the mixing container of FIG. 1.

FIG. 3 shows the mixing receptacle 3 in a perspective view. The mixing receptacle 3 carries an outward projecting, radial circumferential holding flange 17 on its top. The holding flange 17 is designed to be connected to the connection flange 9 of the container frame 2, wherein the holding flange 17 is simultaneously a seal between the connection flange 9 of the container frame 2 and a complementary flange of the mixing head of the mixing machine. The mixing container 3 has a geometry like that known for previously known mixing containers. Therefore, the mixing receptacle 3 comprises an upper, cylindrical section 18, a bordering, conically tapered section 19 and a discharge section 20. The discharge section 20 has an outward projecting, radial connection flange 20.1 at the bottom for connecting the mixing receptacle 3 to the discharge 13 or the entrance of the discharge conduit 14 of the container frame.

The mixing receptacle 3 of the exemplary embodiment shown consists of a vulcanized rubber material with a Shore A hardness of about 50 to 70. Therefore, the hardness of the material selected for the construction of the mixing receptacle 3 corresponds approximately to that of a vehicle tire. The wall thickness of the mixing receptacle 3 of the exemplary embodiment shown is about 3 mm. The inner wall of the mixing receptacle 3 is provided with an adhesion-minimizing coating, wherein a PTFE coating was selected for the exemplary embodiment shown. The hollow chamber 4 is therefore enclosed by the sections 18, 19 in the mixing receptacle 3. Based on the previously cited material this wall consisting of the sections 18, 19 is flexible and can be elastically expanded to a certain extent. The mixing receptacle 3 is produced regarding its dimensions with a certain undersize in its diameter relative to the inside dimensions of the receptacle receiver 7 of the container frame 2.

The mixing receptacle 3 has a stable shape when connected to the container frame 2. This means that the wall formed by the sections 18, 19 retains its original and intended shape even when the mixing container 1 filled with material to be mixed is connected to the mixing head of a mixing machine and the latter is pivoted into its mixing position. The concept "stability of shape" is to be understood in the context of these comments in such a manner that the wall, formed by the sections 18, 19, of the mixing receptacle 3 does not fall into the hollow chamber during such an upside down position of the mixing container 1 and therefore the hollow mixing chamber retains its proper shape. It is not necessarily required for this that no wall movements occur in such a usage of the mixing container. Only a falling in and therefore an appreciable change in the geometry of the hollow chamber 4 should be avoided.

Figure 4:
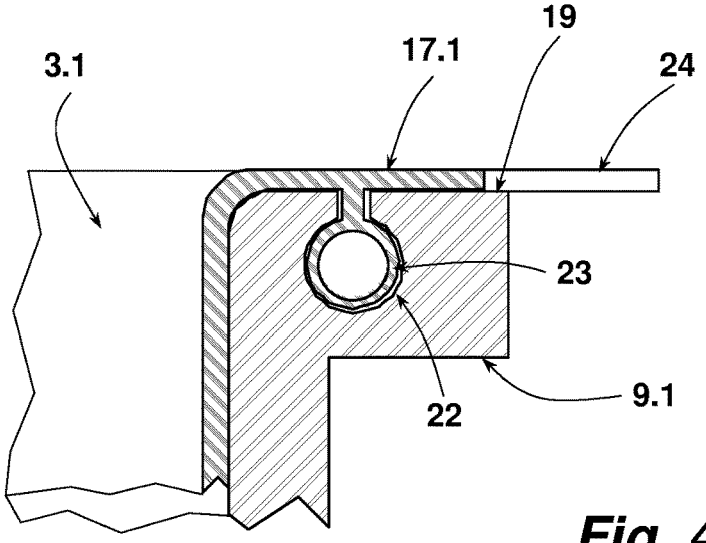
FIG. 4 is a schematic partial cross section through the filling-in-side closure of a mixing container according to another exemplary embodiment.

In the exemplary embodiment of FIG. 1 to 3 the mixing receptacle 3 is connected with its holding flange 17 by screws to the connection flange 9 of the container frame 2. FIG. 4 shows another method for connecting the filling-inside end of a mixing receptacle 3.1 to a container frame is shown in a detailed sectional view. The container frame is shown in FIG. 4 only in the area of a section of its upper, circumferential connection flange 9.1. Otherwise, this container frame corresponds to the container frame 9 of the previous figures. A circumferential, undercut groove 22 is introduced into the top 21 of the connection flange 9.1. This groove 22 serves to lock a connection continuation 23 formed on the holding flange 17.1 of the mixing receptacle 3.1, which continuation is constructed as a hollow chamber profile in the exemplary embodiment shown. This embodiment makes possible a simple pressing in of the thickened part of the connection continuation 23 into the groove 22 of the connection flange 9.1 through the tapered section of the groove 22. The forming of the connection flange 23 is provided in the exemplary embodiment shown at a distance from the radially outer closure of the holding flange 17.1. In addition, the holding flange 17.1 comprises several mounting flaps 24 arranged distributed radially over the circumference. These flaps extend over the outer closure of the connection flange 9.1. They serve as a handle for pulling the connection continuation 23 out of the circumferential groove 22 when the mixing receptacle 3.1 is to be removed from the container frame.

A mixing container 1 filled with un mixed material is connected to the mixing head of a mixing machine. The drive shafts of the mixing tool(s) who shafts extend through the bottom and/or the wall are sealed with an air-supported slot seal opposite the discharge for mixed material. In this mixing machine air is introduced during the mixing process into the mixing receptacle, formed by the mixing container and the mixing head and which is then closed, during an operation which raises the inside pressure. The previously described elastic ductility of the mixing receptacle 3 of the mixing container 1 dampens the elevation of the pressure so that the mixing time can be longer without exceeding a maximum internal pressure for the material to be mixed.

Figure 5:
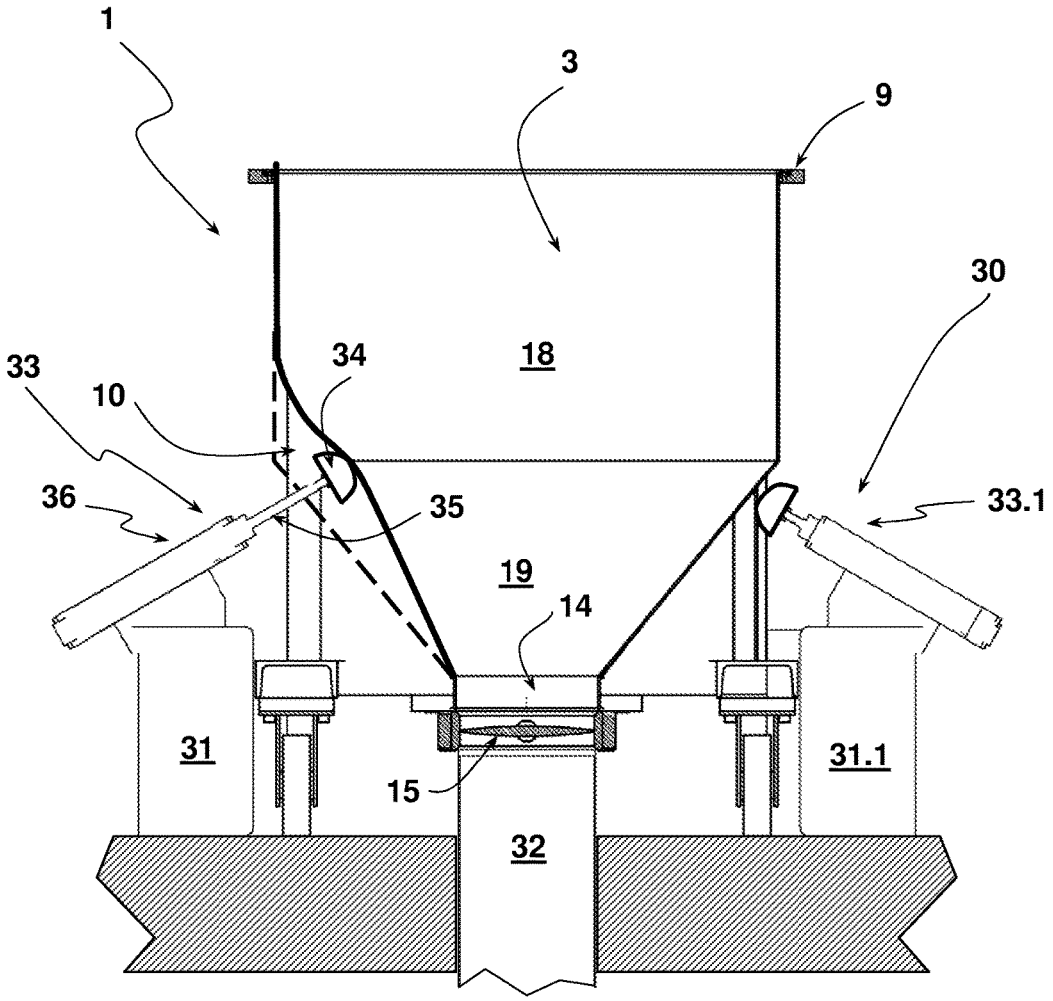
FIG. 5 is the mixing container of FIG. 1 connected to an emptying station during its emptying.

After the conclusion of the mixing process the mixing container 1 is separated from the mixing head of the mixing machine and moved to an emptying station 30. The emptying station 30 comprises an entry position which is made available in the exemplary embodiment shown by two struts 31, 31.1. If the mixing container 1 is in its docking position and in its entry position (see FIG. 5) its discharge conduit 14 is connected to an emptying conduit 32 associated with the emptying station 30. The mixed material in the mixing container 1 is supplied via this emptying conduit 32 to the further processing chain. The closure flap 15 of the mixing container 1 is opened for emptying. FIG. 5 shows the mixing container in a schematic longitudinal section.

The emptying station 30 comprises two pressure devices 33, 33.1. In the following the pressure device 33 is described. The pressure device 33.1 is constructed in the same manner. The pressure device 33 serves to deform a section of the wall of the mixing receptacle 3, as is schematically shown in FIG. 5. The original shape of this wall is shown in dotted lines. To this end the pressure device 33 comprises a pressure body 34 which is on the free end of the piston 35 of a piston-cylinder arrangement characterized in its entirety by the reference numeral 36. The extending of the piston 35 with its pressure body 34 from the associated cylinder against the outer side of the wall of the mixing container, which wall is formed by the sections 18 and 19, brings about a deformation of the wall. Mixing material bridges built up inside the mixing receptacle 3 or mixing material bridges being built up in it during the emptying process can be counteracted and/or eliminated by a multiple pressing in and out in the previously described manner. The pressing in movement of the wall of the mixing container 3 takes place against the return forces of the mixing receptacle 3 and against the material to be mixed in the mixing receptacle 3. For this reason, during a return of the pressure body 34 the wall of the mixing receptacle 3 moves back into its original shape. In the exemplary embodiment shown, the two pressure devices 33, 33.1 can be alternately operated. The distance of the strips 8 of the container frame 2 to each other is sufficient so that the pressure bodies 34 can be run through them.

A complete emptying of the hollow chamber 4 of the mixing receptacle 3 is possible in the previously described manner, in particular without an appreciable development of noise.

Figure 6:
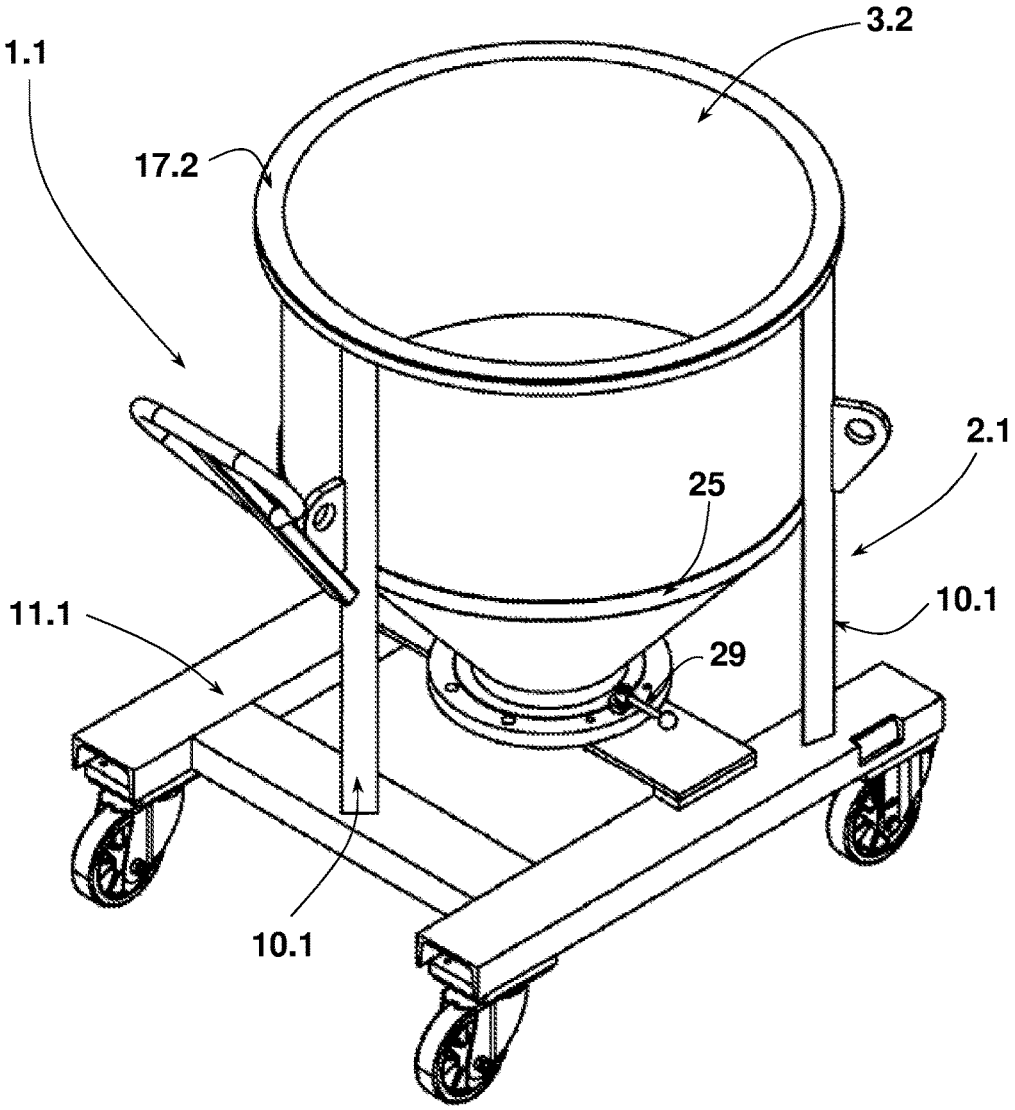
FIG. 6 is a perspective view of another mixing container according to the invention.
Figure 7:
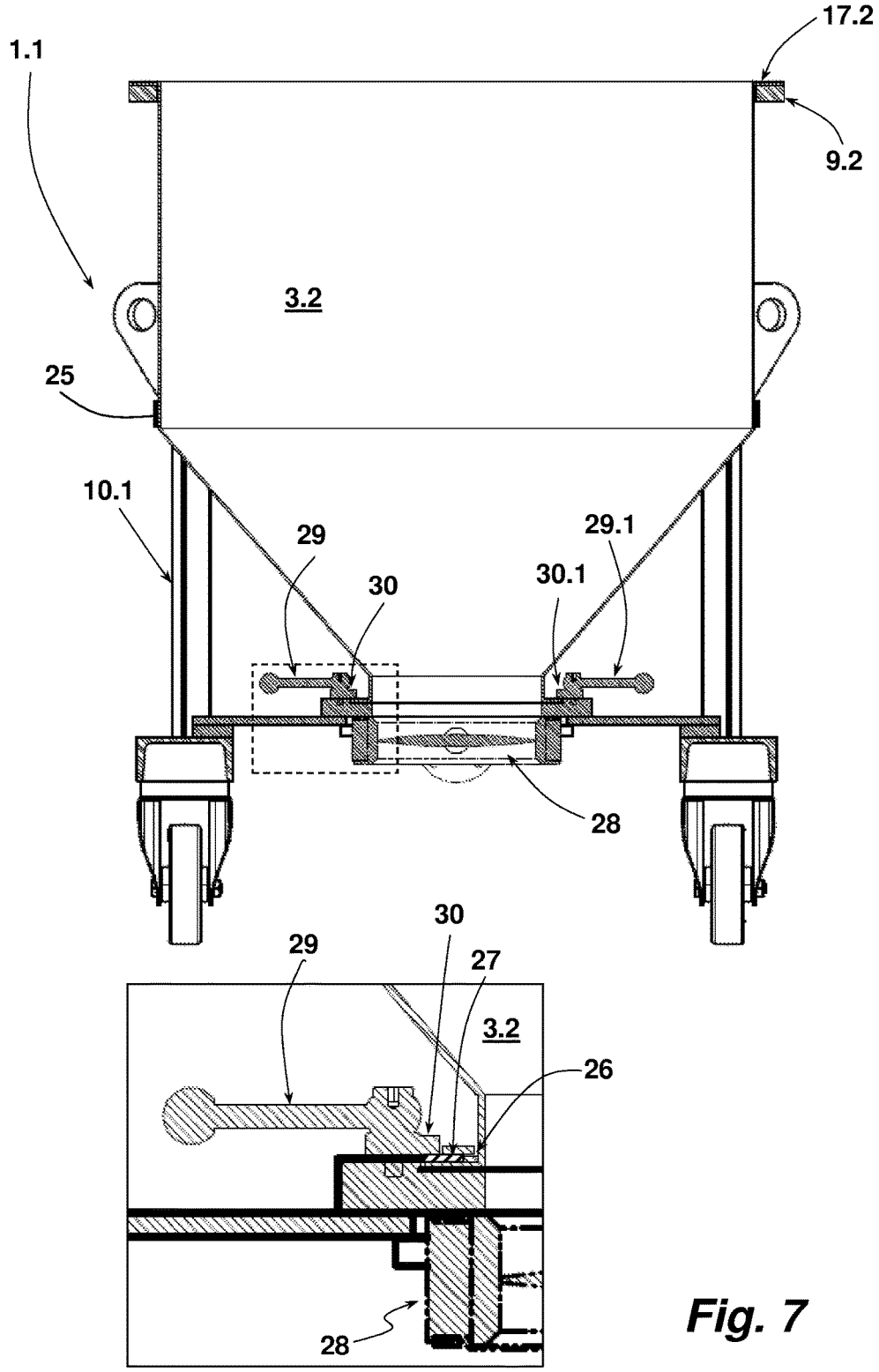
FIG. 7 is a sectional view through the mixing container of FIG. 6.

FIG. 6 shows another mixing container 1.1 with a container frame 2.1 and a mixing receptacle 3.2. The mixing container 1.1 is basically constructed like the mixing container 1 of the previous figures. The mixing container 1.1 differs from the mixing container 1 in that its mixing receptacle 3.2 has a more stable shape. The container frame 2.1 comprises an upper connection flange 9.2 supported by columns 10.1 on the carriage 11.1 for holding the mixing receptacle 3.2. Three columns 10.1 are provided in the exemplary embodiment shown. The columns 10.1 carry a ring iron 25 which supports the receptacle 3.2 in the area of its lowest cylindrical section on the outside.

The mixing receptacle 3.2 has the same properties as the mixing receptacles 3, 3.1 already previously described. The mixing receptacle 3.2 carries a connection flange 26 on its lower end. The connection flange 26 comprises a steel ring as inserter 27. The latter serves to stiffen the connection flange 26. The steel inserter 27 is exposed on the top in its radial, outer edge area. This outer section of the steel inserter 27 serves as a clamping or tensioning surface. Two clamping levers 29, 29.1 serve to fix the connection flange 26 to the discharge 28 of the container frame 2.1. The discharge 28 comprises a recess at the top for receiving the connection flange 26. The bars 29.2, 29.3 of the clamping levers 29. 29.1 extend over the receiver for the locking flange 26 and act on the top of the steel inserter 27 so that the connection flange 26 is entirely pressed in under a certain pretension into the complementary receiver of the discharge 28. In this manner the lower closure of the receptacle 3.2 is sealed off and securely connected to the discharge 28 of the container frame 2.1. The simple connection of the connection flange 26 to the discharge 28 is especially advantageous. To this end only the clamping levers 29, 29.1 need to be activated.

The mixing receptacle 3.2 also comprises a holding flange 17.2 on the top and reinforced by a steel inserter. This flange rests on the top of the connection flange 9.2 of the container frame 2.1. The holding flange 17.2 has a stable shape due to the steel inserter so that no other means is required at this position for holding the mixing receptacle 3.2 with its holding flange 17.2 on the connection flange 9.2.

An emptying of the mixing container 1.1 takes place in the same manner as was described for the mixing receptacle 1.

The present disclosure was described using exemplary embodiments. The claimed mixing container can be modified in other ways without leaving the scope of the valid claims. Therefore, for example the container frame can also comprise circumferential walls or wall sections as long as sufficient access is present in order to be able to influence from the outside the outer wall of the mixing receptacle arranged in it for the cited purposes.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. In general the terms and phrases used herein have their art-recognized meaning, which can be found by reference to standard texts, journal references and contexts known to those skilled in the art. The above definitions are provided to clarify their specific use in the context of the invention.

| List of reference numerals | |
|---|---|
| 1, 1.1 | Mixing container |
| 2, 2.1 | Container frame |
| 3. 3.1, 3.2 | Mixing receptacle |
| 4 | Hollow chamber |
| 5 | Filling opening |
| 6 | Pivot roller |
| 7 | Receptacle receiver |
| 8 | Strip |
| 9, 9.1, 9.2 | Connection flange |
| 10, 10.1 | Column |
| 11, 11.1 | Carriage |
| 12, 12.1 | Longitudinal strut |
| 13 | Discharge |
| 14 | Discharge conduit |
| 15 | Closure flap |
| 16 | Lever |

-continued

| List of reference numerals | |
|---|---|
| 17, 17.1, 17.2 | Holding flange |
| 18 | Cylindrical section |
| 19 | section |
| 20 | Discharge section |
| 20.1 | Connection flange |
| 21 | Top |
| 22 | Groove |
| 23 | Connection continuation |
| 24 | Mounting flap |
| 25 | Ring iron |
| 26 | Connection flange |
| 27 | Steel insert |
| 28 | Discharge |
| 29, 29.1 | Clamping lever |
| 29.2, 29.3 | bar |
| 30 | Emptying station |
| 31, 31.1 | Strut |
| 32 | Emptying conduit |
| 33, 33.1 | Pressure device |
| 34 | Pressure body |
| 35 | Piston |
| 36 | Piston-cylinder arrangement |

We claim:

1. An assembly comprising a mixing container with a container frame seated on pivot rollers so the mixing container can be readily moved, and an emptying station, wherein said mixing container comprises:

a top filling opening with an outward projecting, radial connection flange for connecting the mixing container to a mixing head of an industrial mixing machine;

a bottom discharge with a discharge conduit that can be blocked and opened;

a mixing receptacle with a wall forming a hollow chamber of the mixing container, the wall being flexible in a radial direction, the mixing receptacle mounted in the container frame;

the container frame with the connection flange and the discharge conduit for holding the mixing receptacle, and on which container frame the mixing receptacle is held in such a manner that the wall surrounding the hollow chamber is at least partially accessible in the circumferential direction for bringing about a deformation of the wall in the radial direction; and wherein said emptying station comprises:

an entry position for the mixing container to be moved from outside the emptying station into a docking position of the mixing container within the emptying station, in which docking position the discharge conduit of the mixing container can be coupled to an emptying conduit of the emptying station for receiving the mixed material;

at least one pressure body being the free, moveable end of an adjusting piston of a pneumatically or hydraulically operated piston-cylinder arrangement, which adjusting piston can be moved in a radial direction opposite the wall of the mixing container, and the at least one pressure body is positioned to press the wall inward when the mixing container is moved into the emptying station.

2. The assembly of claim 1, further comprising the mixing receptacle having an outward projecting, radial holding flange which is circumferential and rests on the connection flange of the container frame.

3. The assembly of claim 2, wherein a circumferential groove is introduced into a connection surface of the connection flange, the connection surface faces the mixing head, and the holding flange has a connection continuation that engages into the groove and is held therein.

4. The assembly of claim 1, further comprising the mixing receptacle having a circumferential outward projecting, radial connection flange for connecting the mixing receptacle to the discharge of the container frame.

5. The assembly of claim 4, wherein the connection flange of the mixing receptacle comprises an annular reinforcement inserter.

6. The assembly of claim 5, wherein the reinforcement inserter is exposed at least in sections in the direction of the mixing receptacle for making a clamping surface available, and that for the connection of the connection flange of the mixing receptacle to the discharge of the container frame, the container frame comprises a recessed, annular connection flange receiver and two clamping levers which extend over the connection flange receiver, with bars of the clamping levers holding the connection flange in the connection flange receiver.

7. The assembly of claim 1, wherein the wall of the mixing receptacle is manufactured from an elastically expandable material and the outer circumference of this wall is undersized relative to an inside circumference of a receptacle receiver of the container frame.

8. The assembly of claim 7, wherein the mixing receptacle is manufactured from an elastomer or a polymer with rubber-like elastic properties.

9. The assembly of claim 8, wherein the inside surface of the wall of the mixing receptacle has a coating that reduces adhesion relative to the material to be mixed therein and/or is provided with such a surface structuring.

10. A method for emptying the mixing container in the assembly of claim 1, wherein the at least one pressure body is moved against the wall of the mixing container for deformation of a portion of the wall and is then retracted.

11. The assembly of claim 3, wherein the circumferential groove is an undercut groove.

* * * * *